US009079395B2

(12) United States Patent
Cappello et al.

(10) Patent No.: US 9,079,395 B2
(45) Date of Patent: Jul. 14, 2015

(54) INK-JET PRINTER FOR PRINTING ON CARDS

(75) Inventors: Paolo Cappello, Ivrea (IT); Mauro Mondino, Ivrea (IT)

(73) Assignee: SICPA HOLDING SA, Prilly (CH)

( * ) Notice: Subject to any disclaimer, the term of this patent is extended or adjusted under 35 U.S.C. 154(b) by 0 days.

(21) Appl. No.: 13/977,340

(22) PCT Filed: Dec. 28, 2011

(86) PCT No.: PCT/IB2011/055983

§ 371 (c)(1),
(2), (4) Date: Oct. 16, 2013

(87) PCT Pub. No.: WO2012/090163

PCT Pub. Date: Jul. 5, 2012

(65) Prior Publication Data

US 2014/0028749 A1 Jan. 30, 2014

(30) Foreign Application Priority Data

Dec. 30, 2010 (IT) ..... MI2010A2479

(51) Int. Cl.
*B41J 2/07* (2006.01)
*B41J 2/165* (2006.01)
(Continued)

(52) U.S. Cl.
CPC ..... *B41J 2/07* (2013.01); *B41J 2/16526* (2013.01); *B41J 3/407* (2013.01); *B41J 13/12* (2013.01); *B41J 29/02* (2013.01)

(58) Field of Classification Search
CPC ..... B41J 2/14; B41J 13/0009; B41J 13/12; B41J 2/01; B41J 11/002; B41J 2/07; C09D 11/30; C09D 11/322; C09D 11/40; C09D 11/54; B41M 5/0023
USPC ..... 347/14, 20, 21, 40, 95, 100, 101, 105
See application file for complete search history.

(56) References Cited

U.S. PATENT DOCUMENTS

| | | | | |
|---|---|---|---|---|
| 5,480,243 | A | 1/1996 | Kikkawa et al. | |
| 2008/0158271 | A1 | 7/2008 | Shimizu et al. | |
| 2010/0239789 | A1 * | 9/2010 | Umeda | 428/1.33 |

FOREIGN PATENT DOCUMENTS

| | | |
|---|---|---|
| CN | 1664015 | 9/2005 |
| CN | 1706642 | 12/2005 |

(Continued)

OTHER PUBLICATIONS

International Search Report and Written Opinion issued in PCT/IB2011/055983 dated Feb. 29, 2012.

(Continued)

*Primary Examiner* — Thinh Nguyen
(74) *Attorney, Agent, or Firm* — Greenblum & Bernstein, P.L.C.

(57) ABSTRACT

An ink-jet printer for printing on cards includes a printing station having an ink-jet printhead. A reservoir containing an ink is coupled to the ink-jet printhead. The ink includes: a medium consisting of a low-boiling organic solvent, an auxiliary solvent consisting of a high-boiling organic solvent, and a coloring component soluble in said medium. A driving system is adapted to drive the printhead between a first operative condition wherein the ink ejected by the printhead impinges on the card, and at least a second operative condition, wherein the ink ejected by the printhead does not impinge on the card. A control unit is active on the printhead for commanding ejections thereof, and on the driving system for controlling movement of the printhead. The control unit is configured for commanding an ink ejection in the second operative condition before ink ejection in the first operative condition.

20 Claims, 4 Drawing Sheets

(51) Int. Cl.

| | |
|---|---|
| ***B41J 3/407*** | (2006.01) |
| ***B41J 13/12*** | (2006.01) |
| ***B41J 29/02*** | (2006.01) |

(56) References Cited

FOREIGN PATENT DOCUMENTS

| | | | |
|---|---|---|---|
| CN | 1803946 | | 7/2006 |
| CN | 101457040 | | 6/2009 |
| EP | 1083057 | A2 | 3/2001 |
| EP | 1535742 | A2 | 6/2005 |
| EP | 1604829 | A2 | 12/2005 |
| EP | 1 604 829 | B1 | 11/2010 |
| WO | WO-9851507 | A1 | 11/1998 |

OTHER PUBLICATIONS

China Office Action conducted in counterpart China Appln. No. 201180067487X (Septemer 30, 2014) (w/ partial English language translation).

* cited by examiner

INK-JET PRINTER FOR PRINTING ON CARDS

CROSS-REFERENCE TO RELATED APPLICATIONS

This application is a U.S. National Stage Application of PCT/IB2011/055983, filed Dec. 28, 2011, claiming priority to Application No. MI2010A002479 filed Dec. 30, 2010.

BACKGROUND OF THE INVENTION

The present invention refers to an ink-jet printer for printing on cards.

In particular, the invention can be used for printing on cards comprising a plastic material such as, for example, credit cards, smart cards, magnetic cards, etc.

As known, these cards usually bear signs, images, trademarks, that help the users to identify the purpose of the card and to distinguish each card from the others.

In order to print on such cards, the Applicant has found that particular inks can be employed, that comprise: a medium consisting of a low-boiling organic solvent, an auxiliary solvent consisting of a high-boiling organic solvent, and a colouring component soluble in said medium.

These kind of inks evaporate extremely quickly. Therefore, after a very short time after an ink ejection, portions of dried ink can be detected on the nozzle plate, and in particular in the nozzles.

The ink droplets subsequently ejected by the same nozzles hit these portions of dried ink and change their direction accordingly. This causes problems in term of printing quality, since the ink droplets do not land on the expected spot of the card to be printed, and the results of the printing operation is consequently different from the desired one.

SUMMARY OF THE INVENTION

It is an object of the present invention to provide an ink-jet printer for printing on cards that is capable of obtaining high quality printing results when using inks that evaporate quickly.

It is another object of the present invention to provide an ink-jet printer for printing on cards that is capable of obtaining printing results that are close to those expected.

These and other objects are achieved by an ink-jet printer for printing on cards according to the claims appended hereto.

Further features and advantages will be apparent from the description of a non-exclusive and preferred embodiment of the invention.

BRIEF DESCRIPTION OF THE DRAWINGS

The description is provided for herebelow with reference to the attached drawings, wherein.

DETAILED DESCRIPTION OF THE EMBODIMENT

Figure 1:
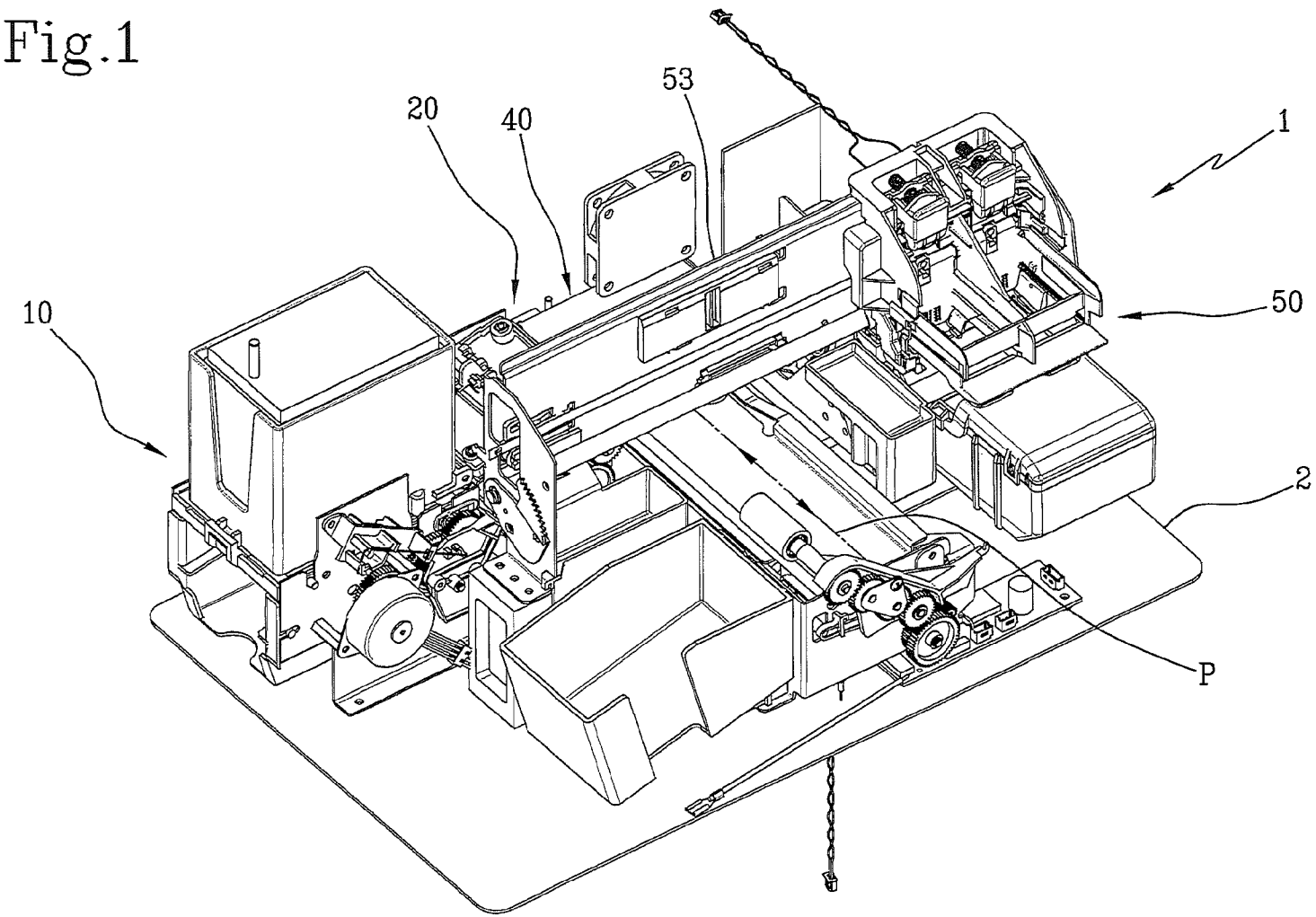
FIG. 1 shows a schematic perspective view of a printer according to the present invention.

In the attached drawings, reference numeral 1 indicates the ink-jet printer according to the present invention.

The printer 1 is suitable for ink-jet printing on cards like credit cards, smart cards, magnetic cards, etc.

The printer 1 (FIG. 1) preferably comprises a storage zone 10 wherein one or more cards are stored.

Preferably the cards comprise a thermoplastic material.

In particular, the thermoplastic material can be selected in the group comprising: polyvinylchloride (PVC); polyvinylchloride (PVC) filled with mineral fillers; laminate polyvinylchloride (PVC); acrylonitrite-butadiene-styrene (ABS) terpolymers; polyethylenterephtalate (PET); glycol modified polyethylenterephtalate (PET-G); polylacticacid (PLA).

The laminate polyvinylchloride is formed by a central layer of polyvinylchloride filled with mineral fillers, and a couple of transparent polyvinylchloride films applied each on a respective surface of the central layer.

Preferably the cards have a substantially plate-like shape, having a substantially rectangular shape in a plant view; the rectangular shape has a larger side and a smaller side.

Preferably the larger side has a length comprised between 80 mm and 90 mm, and in particular substantially equal to 85.7 mm.

Preferably the smaller side has a length comprised between 50 mm and 60 mm, and in particular substantially equal to 54 mm.

Preferably the plate-like shape has a thickness comprised between 0.4 mm and 0.8 mm, and in particular between 0.5 mm and 0.76 mm.

Preferably the dimensions of the card are compliance with the ISO 7810 Standard and/or the CR80 Standard.

Preferably the printer 1 comprises an extraction station 20 or picking station adapted to extract a card 11 from the storage zone 10.

The extraction station 20 picks one card at a time from the storage zone 10 and places it on a support carriage 40.

Upon proper command of a control unit, that manages working of the printer 1, the carriage 40 moves from its starting position, close to the extraction station 20, to a printing position, at a printing station 50.

The printing station 50 (FIGS. 2 to 5) comprises at least one ink-jet printhead 51 for ink-jet printing on said card 11.

The printhead 51 is coupled to at least a reservoir 52 containing ink. Said ink comprises:

- a medium, or vehicle, consisting of a low-boiling organic solvent;
- an auxiliary solvent consisting of a high-boiling organic solvent;
- a colouring component soluble in said medium.

Preferably the vehicle has a boiling temperature lower than 120° C. and in particular lower than 80° C.

Preferably the vehicle is selected in the group of alcohols.

For example, the vehicle can be ethanol, n-propanol, n-butanol.

The vehicle has the tasks of dissolving the various components of the ink and sustaining the formation of the ink bubbles.

Preferably the auxiliary solvent has a boiling temperature higher than 120° C. and in particular higher than 150° C.

Preferably the auxiliary solvent is able to dissolve or to swell the plastic materials, and in particular the thermoplastic material of the cards.

Preferably the auxiliary solvent is soluble in the vehicle.

For example, the auxiliary solvent can be selected in the group comprising: N-methyl-2-pyrrolidone, N-ethyl-2-pyrrolidone, 1,3-dimethyl-imidazolidinone, ϵ-caprolactone, γ_butyrolactone; glycol ethers like: ethylene glycol monomethyl ether, diethylene glycol monobutyl ether, triethylene glycol monomethyl ether, esters like: ethyl lactate, ethyl acetate; or mixtures thereof.

Preferably the colouring component is soluble in the vehicle.

In this context and in the following claims, the term "soluble" indicates solubility in the vehicle of at least 10% w/w.

Preferably, the colouring components belongs to the so called Solvent family according to the Colour Index terminology.

Preferably the colouring component is a substance that is capable of dissolving in the plastic material of which the cards are made, so as to become integral with the cards and to obtain an optimal printing.

For example, the colouring component can be selected in the group comprising: solvent black 29, solvent black 27; solvent blue 67, solvent blue 44, solvent blue 70; solvent yellow 82, solvent yellow 88; solvent red 125, solvent red 122.

Preferably, the ink also comprises one or more additives such as, for example, levelling agents, in order to improve the uniformity of the distribution of the ink on the cards.

For example, such additives can include silicon derivatives.

Figure 2:
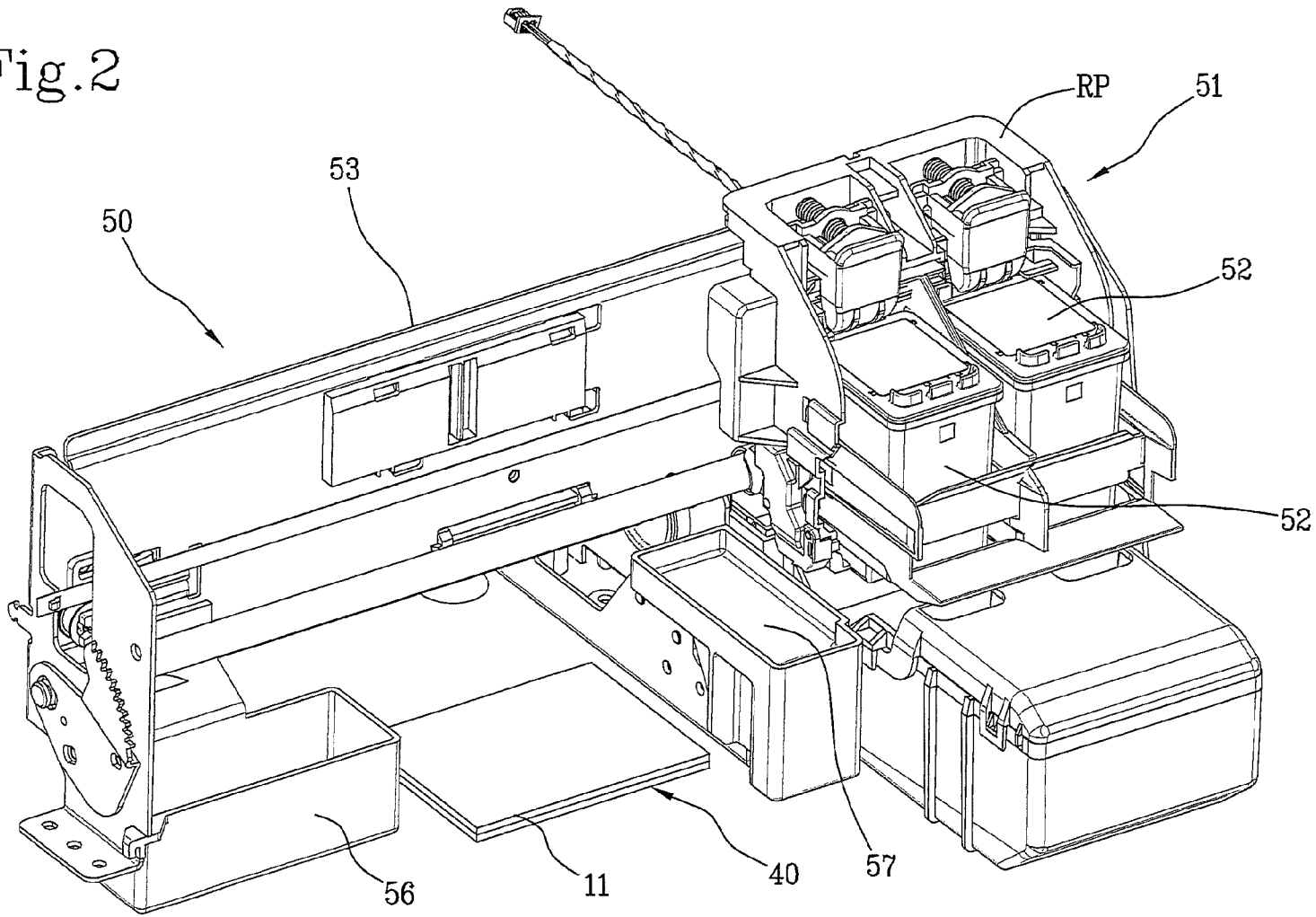
FIG. 2 shows some details of the printer of FIG. 1.
Figure 3:
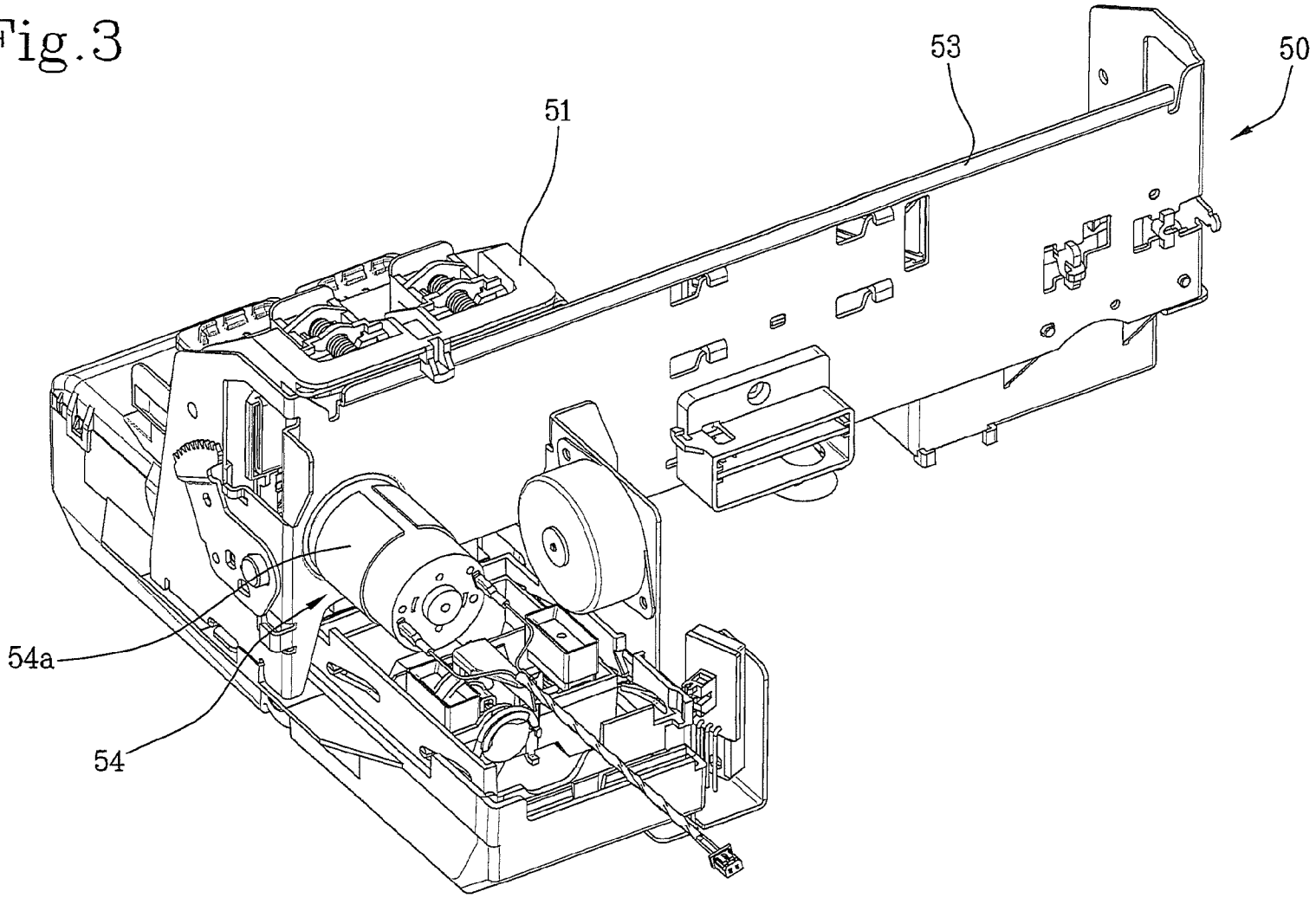
FIG. 3 shows a different view of the details of FIG. 2.

In the preferred embodiment schematically shown in FIG. 2, the printhead 51 is coupled to two reservoirs 52.

Figure 4:
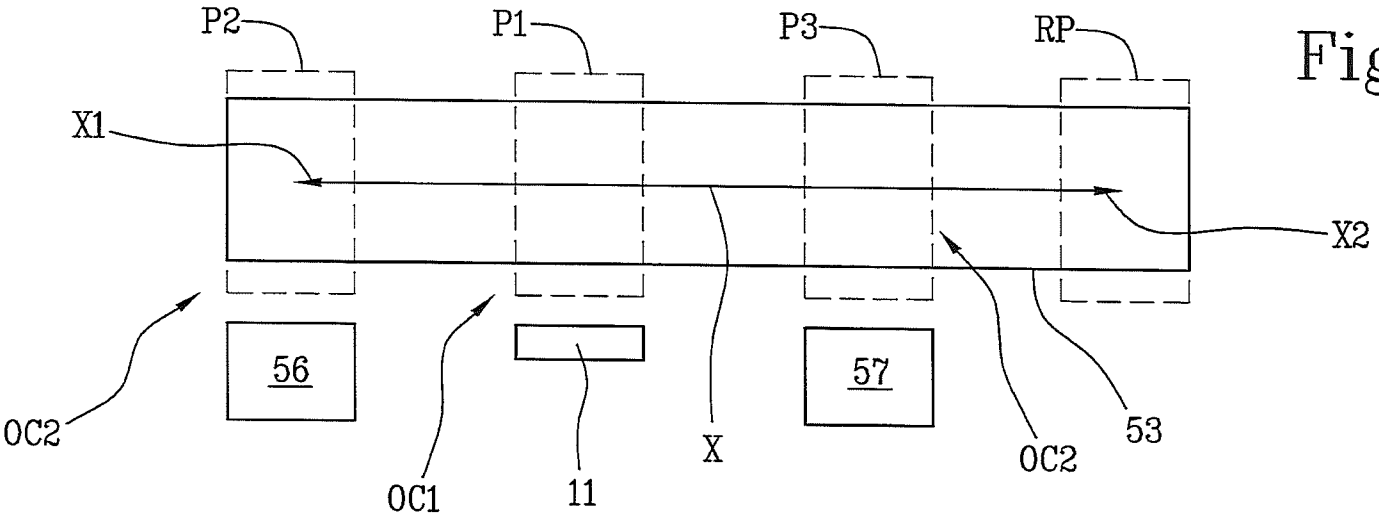
FIGS. 4 and 5 are block diagrams schematically showing some components of the printer of FIG. 1.
Figure 5:
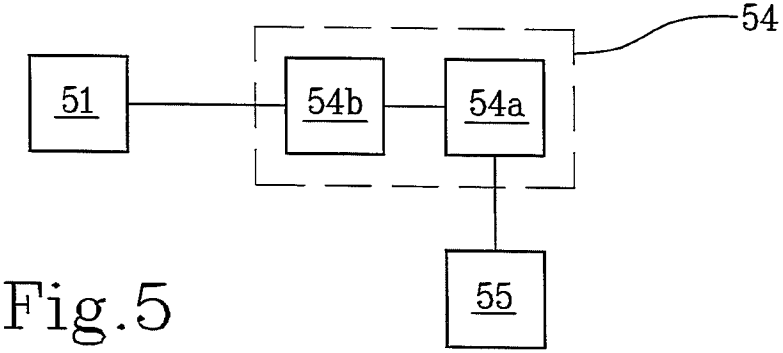

The printing station 50 comprises a driving system 54 (FIG. 5) adapted to drive said printhead 51 between a first operative condition OC1 wherein the ink ejected by the printhead 51 impinges on the card 11, and at least a second operative condition OC2 wherein the ink ejected by the printhead 51 does not impinge on the card 11 (FIG. 4).

Preferably the driving system 54 comprises an electric motor 54*a*, and a kinematic linkage 54*b* that connects the motor 54*a* with the printhead 51.

Preferably the driving system 54 is active on the printhead 51 for moving the same along a path X.

Preferably the first and second operative conditions OC1, OC2 are defined on said path X.

Preferably the printing station 50 further comprises a support plate 53 for the printhead 51.

As schematically shown in FIG. 1, the support plate 53 is oriented according to a direction transverse to the path P of the carriage 40. In practice, the carriage 40 moves along the direction indicated by arrow P; the support plate 53 is transverse, and preferably perpendicular, to such direction.

It is to be noted that, during the printing operation, the carriage 40 is not located in the position shown in FIG. 1: such position is that in which the carriage 40 receives the card 11 from the extraction station 20.

When the printing step has to be performed, the carriage 40 (on which the card 11 is positioned) moves to a different position, substantially below the support plate 53, so that the card 11 is in the position schematically shown in FIGS. 2 and 4.

The support plate is mounted to a frame 2 of the printer 1.

Preferably, the printhead 51 is slidably mounted on the support plate 53.

The driving system 54 is adapted to move the printhead 51 back and forth along the support plate 53 during the printing operation, while ejecting ink onto the card 11.

Preferably the path X is defined on said support plate 53.

The printing station 50 further comprises a control unit 55 active on the printhead 51 for commanding ink ejections thereof.

Preferably the control unit 55 is provided with a memory (not shown), in which data/images to be printed are stored, and with an operative module, that generates proper command signals for the printhead 51 in order to print the stored data.

The control unit 55 is also active on said driving system 54 for controlling movement of said printhead 51.

In particular, the control unit 55 is configured for commanding an ink ejection of the printhead 51 in the second operative condition OC2 before ink ejection in the first operative condition OC1. Preferably, ink ejection of the printhead 51 in the second operative condition OC2 occurs before every ink ejection swath in the first operative condition OC1.

In more detail, every time the printhead 51 has to eject ink onto the card 11 in a swath, or carriage pass, so as to print something on it, the control unit 55 acts on the same printhead 51 commanding a previous ink ejection in the second operative condition OC2. Possible debris or portions of dried ink accumulated in the nozzles of the printhead 51 are removed before the actual printing step is performed, so that the ink ejected for printing follows the desired direction and the printing results is actually the one expected.

Preferably, in the first operative condition OC1 the printhead 51 faces the card 11. In particular, the nozzle plate of the printhead 51 faces the card 11, so that the ink ejected through said nozzles lands onto the card.

Preferably, in the second operative condition OC2 the printhead does not face the card 11.

Preferably, the first operative condition OC1 comprises one or more first positions P1 (FIG. 4) of the printhead 51 on the path X. In particular, the first position(s) is(are) defined on the support plate 53.

In the first positions P1, the printhead 51 (in particular, the nozzles thereof) face the card 11. The first operative condition OC1 may comprise a plurality of first positions P1 since, during a single printing operation, the printhead 51 can be moved, e.g. in a swath, with respect to the card 11, so that more than one ejections occur, in respective different first positions P1, before the printhead 51 is driven to the second operative condition OC2.

Preferably, the second operative condition OC2 comprises at least a second position P2 (FIG. 4) of the printhead 51 on the path X. In particular, the second position P2 is defined on the support plate 53.

In the second position P2 the printhead 51, and in particular the nozzles thereof, does not face the card 11. Therefore, the ink ejected in the second position P2 does not impinge onto the card 11.

Preferably, the printing station 50 comprises at least a first discharge receptacle 56 in which the printhead 51 ejects ink in the second operative condition OC2.

Preferably, the second operative condition OC2 further comprises a third position P3 (FIG. 4) of the printhead 51 on the path X. In particular, the third position P3 is defined on the support plate 53.

Preferably, the first position(s) P1 is/are interposed between the second position P2 and the third position P3. In other terms, the second and third positions P2, P3 are at opposite sides with respect to the first positions P1.

Preferably, the printing station 50 further comprises a second discharge receptacle 57, wherein the printhead 51 ejects ink when it is in the third position P3.

Preferably the path X has a first end X1 and a second end X2.

In a preferred embodiment, the second position (P2) is defined at the first end X1 of the path X.

Thus, as schematically shown in FIG. 4, along the path X are orderly defined (in the figure, from the leftmost end to the rightmost end):

the second position P2, defined at the first end of the path X;
the first position(s) P1;
the third position P3;
a rest position RP, at the second end X2 of the path X; the rest position RP is the position at which the printhead 51 is located when is it not is use.

Preferably, the first discharge receptacle 56 is positioned at the second position P2 of the printhead 51.

In particular, the first discharge receptacle 56 is positioned at the first end X1 of the path X.

In use, the control unit 55 acts on the printhead 51 and on the driving system 54 in order to perform the following steps:
the printhead 51 is moved in the second position P2, a predetermined amount of ink is ejected in the first discharge receptacle 56, so as to clear the nozzles;
the printhead 51 is then moved to the first position (s) P1, and ink is ejected onto the card 11, typically in a swath;
the printhead 51 is then moved to the third position P3, wherein a predetermined amount of ink is discharged into the second discharge receptacle 57;
the printhead 51 is then moved to the first position (s) P1, for another ejection onto the card 11, typically in a further swath in a direction opposite to that of the previous swath.

The above steps can be repeated a number of times, until printing of the card is finished.

The invention can achieve important advantages.

The printer according to the invention is capable of obtaining high quality printing results even using inks that evaporate quickly.

Another advantage consists in that the printer according to the invention is capable of obtaining printing results that are extremely close to those expected.

In the printer of present invention the printhead 51 in the first operative condition OC1 faces the card 11 to be printed.

The printhead 51 in the second operative condition OC2 does not face the card 11 to be printed.

Said second operative condition OC2 further comprises a third position P3 on said path X.

In the printer of present invention the one or more first positions P1 are interposed between the second and the third positions P2, P3 on said path X.

Said card 11 has a substantially plate-like shape, having a substantially rectangular shape in a plant view, said rectangular shape having a larger side and a smaller side.

Said larger side has a length comprised between 80 mm and 90 mm.

Said smaller side has a length comprised between 50 mm and 60 mm.

In the printer of present invention the plate-like shape has a thickness comprised between 0.4 mm and 0.8 mm.

In the printer of present invention the step of driving said printhead 51 between said first and second operative conditions OC1, OC2 comprises moving said printhead 51 along a path X on which said first and second operative conditions OC1, OC2 are defined.

Ink ejection in said first operative condition OC1 occurs during swaths of the printhead along said path X, wherein ejection of the printhead in the second operative condition OC2 occurs before every ink ejection swath in the first operative condition.

Said first operative condition OC1 comprises one or more first positions P1 on said path X, and said second operative condition OC2 comprises at least a second position P2 on said path X.

The printhead 51 in the first operative condition OC1 faces the card 11 to be printed.

The printhead 51 in the second operative condition OC2 does not face the card 11 to be printed.

Said second operative condition OC2 further comprises a third position P3 on said path X.

Said first positions P1 are interposed between the second and the third positions P2, P3 on said path X.

In one embodiment of a method according to at least a first discharge receptacle (56) is provided in which said printhead (51) ejects ink in the second operative condition (OC2).

In the printer of present invention is comprised a second discharge receptacle 57, said printhead 51 facing said first discharge receptacle 56 in the second position P2, said printhead 51 facing said second discharge receptacle 57 in the third position P3.

In the printer of present invention is comprised a support plate 53 on which said printhead 51 is slidably mounted, said path X being defined along said support plate 53.

The invention claimed is:

1. An ink-jet printer for printing on cards, comprising a printing station including:
at least one ink-jet printhead for printing on a card;
a reservoir containing an ink and coupled to the at least one ink-jet printhead, said ink comprising: a medium consisting of a low-boiling organic solvent, an auxiliary solvent consisting of a high-boiling organic solvent, and a colouring component soluble in said medium;
a driving system adapted to drive said printhead between a first operative condition wherein the ink ejected by the printhead impinges on the card, and at least a second operative condition wherein the ink ejected by the printhead does not impinge on the card;
a control unit active on said printhead for commanding ejections thereof, and on said driving system for controlling movement of said printhead, said control unit being configured for commanding an ink ejection in said second operative condition before ink ejection in said first operative condition.

2. The ink-jet printer according to claim 1, wherein said driving system is active on said printhead for moving said printhead along a path, said first and second operative conditions being defined on said path.

3. The ink-jet printer according to claim 2, wherein ink ejection in said first operative condition occurs during swaths of the printhead along said path, and wherein ejection of the printhead in the second operative condition occurs before every ink ejection swath in the first operative condition.

4. The ink-jet printer according to claim 2, wherein said first operative condition comprises one or more first positions on said path, and said second operative condition comprises at least a second position on said path.

5. The ink-jet printer according to claim 4, wherein said second operative condition further comprises a third position on said path, and wherein said one or more first positions are interposed between the second and the third positions on said path.

6. The ink-jet printer according to claim 5, wherein said printing station further comprises a second discharge receptacle, said printhead facing said first discharge receptacle in the second position, said printhead facing said second discharge receptacle in the third position.

7. The ink-jet printer according to claim 5, wherein said printing station further comprises a support plate on which said printhead is slidably mounted, said path (X) being defined along said support plate.

8. The ink-jet printer according to claim 5, wherein said second position is defined at an end of said path.

9. The ink-jet printer according to claim 4, wherein said second position is defined at an end of said path.

10. The ink-jet printer according to claim 1, wherein the printhead in the first operative condition faces the card to be printed and the printhead in the second operative condition does not face the card to be printed.

11. The ink-jet printer according to claim 1, wherein said printing station further comprises at least a first discharge receptacle in which said printhead ejects ink in the second operative condition.

12. The ink-jet printer according to claim 11, wherein said printing station further comprises a second discharge receptacle, said printhead facing said first discharge receptacle in the second position, said printhead facing said second discharge receptacle in the third position.

13. The ink-jet printer according to claim 12, wherein said printing station further comprises a support plate on which said printhead is slidably mounted, said path being defined along said support plate.

14. The ink-jet printer according to claim 1, forming a combination with the cards, wherein said cards are comprised of a thermoplastic material.

15. The ink-jet printer according to claim 14, wherein said thermoplastic material is selected from the group comprising: polyvinylchloride; polyvinylchloride filled with mineral fillers; laminate polyvinylchloride; acrylonitrite butadiene styrene terpolymers; polyethylenterephtalate; polylacticacid.

16. The ink-jet printer according claim 1, wherein said medium has a boiling temperature lower than 120° C.

17. The ink-jet printer according to claim 1, wherein said medium is selected from the group of alcohols.

18. The ink-jet printer according to claim 1, wherein said auxiliary solvent has a boiling temperature higher than 120° C.

19. The ink-jet printer according to claim 1, wherein said auxiliary solvent is able to dissolve or to swell plastic materials.

20. A method for ink-jet printing on a card, comprising:

printing on the card with an ink-jet printhead, coupled to a reservoir containing an ink comprising: a medium consisting of a low-boiling organic solvent, an auxiliary solvent consisting of a high-boiling organic solvent, and a colouring component soluble in said medium;

driving said printhead between a first operative condition in which the ink ejected by the printhead impinges on the card, and at least a second operative condition in which the ink ejected by the printhead does not impinge on the card;

commanding ink ejection by the printhead so that said printhead ejects ink in said second operative condition before ejection in said first operative condition.

* * * * *